US006516076B1

(12) United States Patent
Marlin

(10) Patent No.: US 6,516,076 B1
(45) Date of Patent: Feb. 4, 2003

(54) MODULAR HORN LOUDSPEAKER

(75) Inventor: Bruce Marlin, Ennis, TX (US)

(73) Assignee: Atlas Sound, L.P., Ennis, TX (US)

( * ) Notice: Subject to any disclaimer, the term of this patent is extended or adjusted under 35 U.S.C. 154(b) by 167 days.

(21) Appl. No.: 09/709,160

(22) Filed: Nov. 9, 2000

Related U.S. Application Data

(60) Provisional application No. 60/217,356, filed on Jul. 12, 2000.

(51) Int. Cl.[7] ..... H04R 1/02; G10K 13/00; G10K 11/00

(52) U.S. Cl. ..... 381/340; 381/342; 381/343; 381/397; 181/159; 181/177

(58) Field of Search ..... 381/340, 341, 381/342, 345, 346, 347, 397, 396, 343, 398, 400, 401, 420, 430, 339; 181/152, 153, 159, 187, 175, 177

(56) References Cited

U.S. PATENT DOCUMENTS

| | | | |
|---|---|---|---|
| 1,626,102 | A | 4/1927 | Showers |
| 1,727,651 | A | 9/1929 | Knudsen |
| 1,747,830 | A | 2/1930 | Harrison |

(List continued on next page.)

OTHER PUBLICATIONS

*An Application of Bob Smith's Phasing Plug*, 61st AES Convention, Nov. 1978, pp 1–12, Francher M. Murray.
*Loudspeaker and Headphone Handbook*, pp 93–96, 381,391 and 396 John Borwick, Editor 1988.

(List continued on next page.)

*Primary Examiner*—Rexford Barnie
(74) *Attorney, Agent, or Firm*—J. Andrew McKinney, Jr.

(57) ABSTRACT

A modular horn loudspeaker principally intended for use on emergency vehicles consists of three coaxially aligned cup-shaped parts, a sound chamber, a cover fitted to the sound chamber and a housing. The first embodiment of the modular, compact horn loudspeaker is implemented with a single siren driver and includes a dome-shaped driver diaphragm integrally formed onto an interior surface of the sound chamber. The sound chamber is an acoustical boundary defining member having curved propagation paths or horn throat channels formed in relief on a cup-shaped exterior surface. The sound chamber is coaxially aligned with and received in a tightly fitted cup-shaped cover member to define a plurality of curved horn throats of expanding rectangular cross sectional dimension directing the sound waves rearwardly around the diaphragm periphery and toward a housing rear wall. A magnet assembly is pressed into a heat sink formed in a larger and concentrically aligned cup-shaped housing having a closed rear wall for redirecting the sound wave forwardly, around the periphery of the cover. The horn mouth is defined by the circular peripheral wall of the external cup-shaped housing and the concentric and coaxially aligned sound chamber/cover assembly. A second, two driver embodiment of the modular loudspeaker places two drivers with magnet assemblies back-to-back, so that a first sound chamber's horn mouth exit apertures face a second sound chamber's horn mouth exit apertures. The resulting assembly yields eight paths from two sound chambers which blend into one coherent sound source, when placed in a housing adapted to accommodate two drivers. The back-to-back drivers are inserted in a larger bowl shaped back cover or housing having a first open end, a substantially frustoconical sidewall and a closed back end.

24 Claims, 13 Drawing Sheets

U.S. PATENT DOCUMENTS

| | | | | | |
|---|---|---|---|---|---|
| 1,765,486 | A | | 6/1930 | Hawley et al. | |
| 1,767,812 | A | | 6/1930 | Polydoroff | |
| 1,809,035 | A | | 6/1931 | Hawley | |
| 1,809,314 | A | | 6/1931 | Ross | |
| 1,810,708 | A | | 6/1931 | Hutchison | |
| 1,832,763 | A | | 11/1931 | Campbell | |
| 1,836,075 | A | | 12/1931 | Hutchison | |
| 1,935,869 | A | | 11/1933 | Yoshizawa | |
| 2,030,648 | A | | 2/1936 | Meissner | |
| 2,160,166 | A | | 5/1939 | Pausin | |
| 2,301,459 | A | | 11/1942 | Sanial | |
| 2,858,377 | A | | 10/1958 | Levy | |
| 2,957,054 | A | | 10/1960 | Levy | |
| 2,981,359 | A | | 4/1961 | Carlisle | |
| 3,672,462 | A | | 6/1972 | Aurer, Jr. | |
| 3,852,529 | A | | 12/1974 | Schafft | |
| 3,866,710 | A | | 2/1975 | Cesati | |
| 3,991,286 | A | | 11/1976 | Henricksen | |
| 4,031,337 | A | * | 6/1977 | Okamura et al. | 381/342 |
| 4,040,503 | A | | 8/1977 | Hino | |
| 4,116,302 | A | | 9/1978 | Seebinger | |
| 4,164,631 | A | * | 8/1979 | Garner et al. | 381/340 |
| 4,210,223 | A | | 7/1980 | Gillum | |
| 4,454,927 | A | | 6/1984 | Seebinger | |
| 4,550,229 | A | | 10/1985 | Hwang | |
| 4,790,020 | A | | 12/1988 | Lin | |
| 4,811,403 | A | | 3/1989 | Henricksen | |
| 4,884,523 | A | | 12/1989 | Wheeler | |
| 4,893,343 | A | | 1/1990 | Bader | |
| 4,923,031 | A | | 5/1990 | Carlson | |
| 4,933,975 | A | | 6/1990 | Button | |
| 5,397,866 | A | | 3/1995 | Lyons | |
| 5,637,840 | A | | 6/1997 | Kim | |
| 5,757,942 | A | * | 5/1998 | Kamatani et al. | 381/340 |
| 5,804,774 | A | | 9/1998 | Ford | |
| 5,970,158 | A | | 10/1999 | Beltran | |
| 6,064,745 | A | * | 5/2000 | Avera | 381/343 |
| 6,127,918 | A | * | 10/2000 | Lin | 340/388.1 |

OTHER PUBLICATIONS

*Handbook for Sound Engineers*, pp. 545–558, Glen M. Ballou, Editor, 2nd Ed., 1991.

*Transfer Mechanisms in Loudspeakers: Analysis Measurement and Design*, AED Loudspeakers, vol. 4, pp. 97–110, Clifford A. Henricksen, 1996.

* cited by examiner

MODULAR HORN LOUDSPEAKER

RELATED APPLICATION INFORMATION

The instant non-provisional patent application claims benefit of co-pending provisional application No. 60/217,356, entitled Modular Siren Loudspeaker and filed on Jul. 12, 2000, the entire disclosure of which is incorporated herein by reference.

BACKGROUND OF THE INVENTION

1. Field of the Invention

The present invention relates to horn loudspeakers, and, more particularly, to compact horn loudspeakers suitable for paging or emergency signaling uses in harsh environments and confined spaces such as are found on emergency vehicles.

2. Discussion of the Prior Art

Emergency vehicles (e.g., ambulances) usually carry horn loaded siren loudspeakers for emergency signaling, and in the past it was customary to mount one or more siren loudspeakers on an overhead light bar or on a front bumper.

Traditional horn loaded siren loudspeakers are not well suited for use on some modern vehicles, however. In the past, when it was desired to aim the siren's sound forwardly, a siren loudspeaker was mounted on the front bumper, in front of the grille covering the radiator. On cars built in the 1980's, front bumpers projected forwardly four to six inches, providing an exterior surface with ample room for mounting a traditional horn loaded siren loudspeaker.

Many modern vehicles have integrally contoured and painted bumper surfaces and so do not have a front bumper surface well suited to mounting a siren loudspeaker. The siren loudspeaker can be mounted under the hood, behind the grill and in front of the radiator, but this mounting location presents a number of problems. There is very little room between the grille and the radiator, the radiator is often hot, and the siren loudspeaker is exposed to a damp, corrosive environment.

Other loudspeaker designers have sought to solve these problems by fashioning loudspeakers from stacks of metal, planar, plate-like members defining folded or reentrant horns. For example, U.S. Pat. No. 5,970,158, to Beltran, discloses a compact horn loudspeaker intended for use behind the grille of an emergency vehicle or the like. The Beltran horn loudspeaker does achieve a small front to back thickness dimension, but is expensively fabricated from a plurality of planar plate-like aluminum pieces joined in a stack with vulnerable, exposed seams running around the periphery of the horn.

Another problem is that the small space available behind the grille may not be suitable for mounting a siren loudspeaker of sufficient power; there are applications requiring more acoustic output than one compact siren driver can produce. For example, when using the Beltran siren, installers may not be able to find sufficient space to mount two or more of Beltrans' siren housings. Airflow does have to reach the radiator, after all; one cannot simply cover the interior of the grille with sirens. Another problem with requiring the siren installers to mount two separate sirens is that separate wiring connections have to be made, thus increasing the cost of installation and the opportunity for incorrect wiring. If the siren loudspeakers are wired in parallel, impedance is halved, and if wired in series, impedance is doubled, as compared to a single siren driver. Incorrect wiring can lead to poor acoustic performance or equipment failure due to an overcurrent condition.

Turning to a more general view, the prior art includes a number of compact folded or reentrant horn loudspeakers for use in a variety of settings. For example, the *Handbook for Sound Engineers 2d. Edition,* pp 545–558, Glen M. Ballou, Editor, 1991, describes a number of "folded horns" folded to make "compact" products. In the examples cited, the sound path makes one or two 180 degree turns, effectively reversing or folding the sound path back on itself.

U.S. Pat. No. 1,767,812, to W. J. Polydoroff, discloses an "acoustical horn" including a compression driver and a "body" including a continuous winding sound channel having a flared terminal portion constituting the mouth of the horn. The body is, preferably, made in two or three "matched discs or sections" independently molded, machined or die pressed and then glued, cemented or fastened together in a stack.

U.S. Pat. No. 1,832,763, to W. M. Campbell, discloses a horn-loaded loudspeaker including what is called an "acoustic chamber" intended to reflect or deflect sound waves to redirect sound received in a throat tube 9, directing the sound towards exit slots 7.

In 1928 H. C. Harrison invented an acoustic horn which became the subject of U.S. Pat. No. 1,747,830. Harrison's acoustic horn was given a "compact form" obtained by "providing a reentrant horn in which the sound waves traverse the space within the enclosing walls a plurality of times and expand progressively at a suitable rate in their passage therethrough."

U.S. Pat. No. 2,160,166 issued to H. R. Pausin in 1939 and includes a horn for a loudspeaker cast in metal, preferably aluminum, in two parts. The horn is formed of a lower section separably attached to an upper section. The lower section includes the mount for a compression driver and a horn mouth; the upper section is a single casting providing a folded horn throat arcing through 180 degrees and connected to the horn mouth for coupling an acoustic wave to external air.

U.S. Pat. No. 2,957,054, to Levy et al, discloses a transducer or horn-loaded loudspeaker having a driver assembled into an inner compartment of a mechanical acoustic body formed as a horn throat member received within a flared body which forms the horn mouth. Levy's loudspeaker is characterized as a "reflex horn speaker" having "acoustic ducts" fabricated within two complimentary dieformed members.

U.S. Pat. No. 2,301,459, to A. J. Sanial, disclosing a loudspeaker called an "electric megaphone" wherein a loudspeaker driver projects an acoustic wave into a tubular extension projecting forwardly which is in communication with a rearward or reentrant annular space characterized as a reversely extending annular passage for communication with a horn mouth. An outer cylindrical housing is closed at the rear end and the soundwave from the annular passage reflects at a solid rear wall and is reflected forwardly to project out and be coupled to the external air by a flared end or horn mouth.

U.S. Pat. No. 5,804,774, to Ford et al, discloses a ported reflex horn. The background section of this patent discusses "re-entrant" horns having horn sections which "fold back" on one another, offering a compact alternative to straight horns.

These background references illustrate the many approaches taken in fashioning compact horn-loaded loudspeakers. None of the designs illustrated therein address all of the problems identified by the applicant, as discussed above. In particular, the prior art does not teach or suggest an optimum structure for a compact siren loudspeaker which impervious to the environment, is easy and inexpensive to manufacture, and is easy to install. The prior art is also silent on how one may fashion a siren loudspeaker in a modular configuration, permitting the installer to select a siren having an optimum output power rating for installation under the hood of an emergency vehicle, or the like.

There is a need, therefore, for a modular compact siren assembly adapted for use in small spaces and harsh environments, such as under the hood of an emergency vehicle.

OBJECTS AND SUMMARY OF THE INVENTION

Accordingly, it is a primary object of the present invention to overcome the above mentioned difficulties by providing a modular, compact siren assembly adapted for use in small spaces and harsh environments, such as under the hood of an emergency vehicle.

Another object of the present invention is to provide a modular system of loudspeaker elements adapted for economical manufacture and ease of assembly.

Yet another object of the present invention is to provide a modular loudspeaker which is easily installed under the hood of a vehicle in the confined space between the grille and the radiator.

The aforesaid objects are achieved individually and in combination, and it is not intended that the present invention be construed as requiring two or more of the objects to be combined unless expressly required by the claims attached hereto.

A modular horn loudspeaker principally intended for use on emergency vehicles consists of three coaxially aligned cup-shaped parts, a sound chamber, a cover fitted to the sound chamber and a housing. The first embodiment of the modular, compact horn loudspeaker of the present invention is implemented with a single siren driver; the single driver embodiment includes a dome-shaped driver diaphragm integrally formed onto an interior surface of the sound chamber. The sound chamber is an acoustical boundary defining member having curved propagation paths or horn throat channels formed in relief on a cup-shaped exterior surface. The sound chamber is coaxially aligned with and received in a tightly fitted cup-shaped cover member to define a plurality of curved horn throats of expanding rectangular cross sectional dimension directing the sound waves rearwardly around the diaphragm periphery and toward a housing rear wall. A magnet assembly is pressed into a heat sink formed in a larger and concentrically aligned cup-shaped housing having a closed rearwall for redirecting the sound wave forwardly, around the periphery of the cover. The horn mouth is defined by the circular peripheral wall of the external cup-shaped housing and the concentric and coaxially aligned sound chamber/cover assembly.

The largest of the three coaxially aligned, concentrically assembled cup-shaped members is the housing which incorporates a heat sink/magnet assembly, is closed at the rear and open at the front, forming a horn mouth to couple acoustic energy to external air. The cover member opens rearwardly, is closed at the front and is slightly larger in diameter than the sound chamber which fits and is sealed within the cover. The sound chamber is contoured on its interior surface to follow the dome shaped surface of the diaphragm and incorporates an integral phase plug spaced from the diaphragm, as is well known in the art. The outer surface of the sound chamber member incorporates the radially arrayed first, second, third and fourth horn throat sections, respectively. The geometry of each horn throat is defined by combined surfaces of the sound chamber and cover, when coaxially nested together. The one driver modular siren loudspeaker can be characterized as having a folded sound path beginning proximate the diaphragm and ending in front of the horn mouth. The sound chamber horn throats form parallel parts of the sound path. Four diaphragm exits or slots penetrate the sound chamber at the closed end, providing fluid communication between the interior surface and the exterior surface. The sound chamber horn throats begin at the forward, closed end with respective transversely opening diaphragm exits or slots disposed around an integral phase plug that is spaced from the diaphragm. The horn throats diverge transversely or radially from the front, center portion of the of the sound chamber, turning rearwardly and following the contour of the sound chamber's cup-shaped exterior surface. The four horn throats terminate in an open space proximate the rear wall of the cup-shaped housing. The sound path is effectively recombined at the terminus of the four horn throats and the recombined pressure wave is reflected forwardly, redirected by 180 degrees. The sound path continues in the annular space between the exterior of the cover and the interior of the housing horn mouth toward the front of the housing, exiting into free space through the horn mouth.

A second, two driver embodiment of the modular loudspeaker (hereinafter, the two driver embodiment) involves an alternate assembly method placing two drivers with magnet assemblies back-to-back, so that a first sound chamber's horn mouth exit apertures face a second sound chamber's horn mouth exit apertures. The resulting assembly yields eight paths from two sound chambers which blend into one coherent sound source, when placed in a housing adapted to accommodate two drivers. The back-to-back drivers are inserted in a larger bowl shaped back cover or housing having a first open end, a substantially frustoconical sidewall and a closed back end of only slightly smaller diameter, the housing being nearly cylindrical. A front cover is tightly fitted over the front facing sound chamber. The magnet assemblies, being back-to-back, are not received within a fitted heat sink incorporated into the housing, as for the one driver embodiment.

Both the one driver and two driver embodiments are preferably fabricated from diecast aluminum. The one driver embodiment preferably utilizes a Neodymium magnetic circuit for reduced size. Alternatively, the magnetic circuit could be fabricated from conventional Alnico or Ferrite material for applications where size is not an important issue. Aluminum was selected to provide thermal conductive properties for the temperature sensitive Neodymium magnet material. The use of Alnico or Ferrite materials allow the modular loudspeaker to be fabricated from plastic or other cast or molded materials having reduced thermal conductivity.

The above and still further objects, features and advantages of the present invention will become apparent upon consideration of the following detailed description of a specific embodiment thereof, particularly when taken in conjunction with the accompanying drawings, wherein like reference numerals in the various figures are utilized to designate like components.

DESCRIPTION OF THE PREFERRED EMBODIMENT

Figure 1:
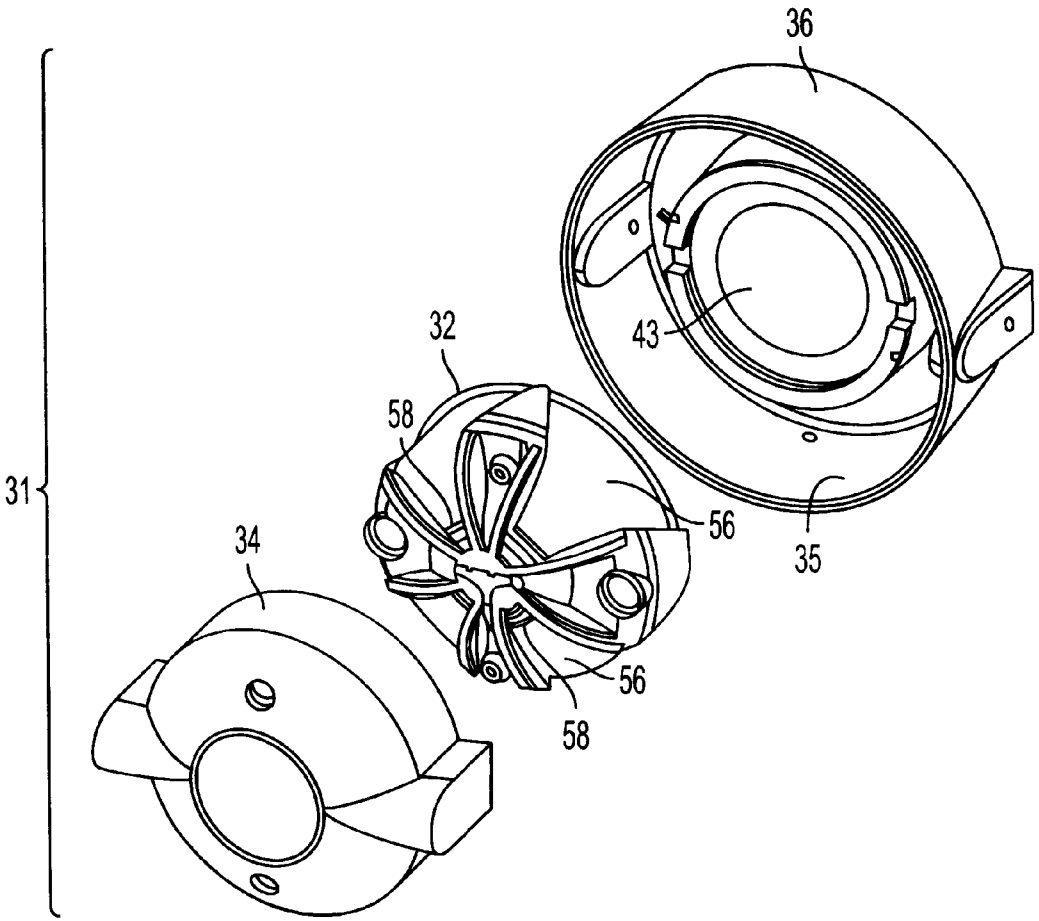
FIG. 1 is a perspective exploded view of three cup shaped members comprising a horn assembly and defining the acoustic path for the single driver embodiment of the modular horn loudspeaker, in accordance with the present invention.
Figure 2:
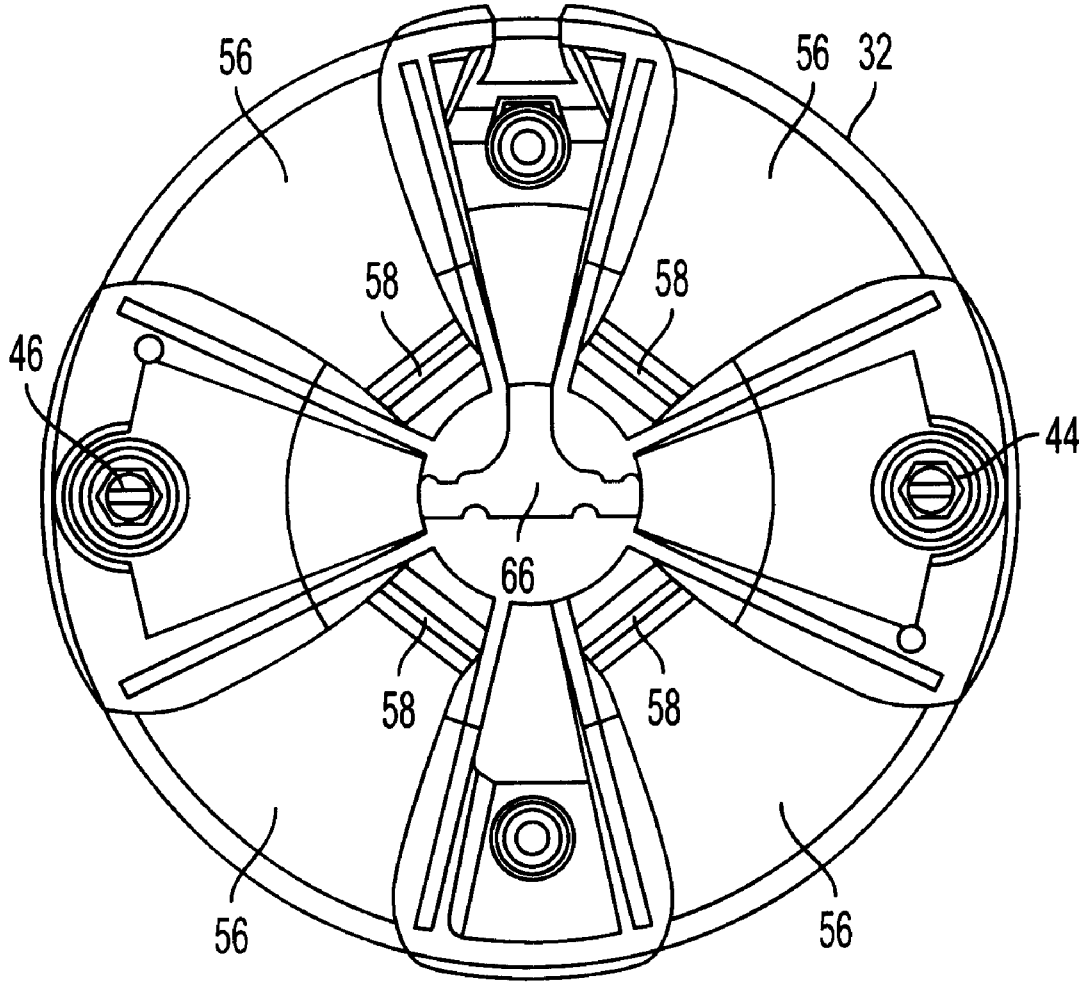
FIG. 2 is a top view in elevation of a first embodiment of the modular horn loudspeaker sound chamber, in accordance with the present invention.

As seen in FIGS. 1–22, modular horn loudspeaker 30 is principally intended for use on emergency vehicles and the like as a siren or sound reinforcement loudspeaker. Referring now to FIG. 1, a one driver embodiment of modular horn loudspeaker 30 includes a horn assembly 31 comprising three cup-shaped parts, a sound chamber 32, a cover 34 fitted to the sound chamber 32 and a housing 36. As shown particularly in FIGS. 13–19, housing 36 may also be characterized as a heat sink or pot and has an open front end or horn mouth 35 opposite a closed rear end 37 and separated therefrom by a substantially cylindrical wall section. A dome-shaped driver diaphragm assembly 38 includes a voice coil wound on a cylindrical former affixed to the rear of a dome shaped diaphragm; diaphragm assembly 38 is preferably integrally formed onto an interior surface of sound chamber 32, which is an acoustical boundary defining member having curved propagation paths or horn throat channels 56 formed in relief on the cup-shaped sound chamber exterior surface 62. Sound chamber 32 is received in a tightly fitted cup-shaped cover member 34 to define a plurality of curved horn throats directing the sound waves rearwardly around the diaphragm 38 and rearwardly toward the magnet assembly 43 which is comprised of annular magnet 42 and coaxially aligned magnet pole piece 40 to define an annular magnetic gap sized to receive the voice coil and former of diaphragm assembly 38. Magnet assembly 43 is preferably press-fit into the heat sink pocket 100 defined by and formed in larger and concentrically aligned cup-shaped housing 36 having closed rear wall 37 for redirecting the sound wave forwardly, around the periphery of the cover 34. Functionally, the loudspeaker horn mouth 35 is defined by the circular peripheral wall of the external cup-shaped housing 36 and the concentric and coaxially aligned sound chamber/cover assembly.

As best seen in FIG. 1, the one driver modular horn loudspeaker is formed of three coaxially aligned, concentrically assembled cup-shaped members. The largest is housing 36 which incorporates a magnet assembly 43 fitted into a pocket or heat sink 100. As noted above, housing 37 is closed at the rear and open at the front, forming a horn mouth 35 to couple acoustic energy to external air. Cover member 34 opens rearwardly, is closed at the front and is slightly larger in diameter than sound chamber 32 which fits and is sealed within the cover 34. Sound chamber 32 is contoured on its interior surface 60 to follow the dome shaped surface of the diaphragm 38 and incorporates an integral phase plug 64 spaced from the diaphragm, as is well known in the art. The outer surface 62 of the sound chamber member incorporates four radially arrayed horn throat sections 56. The geometry of each horn throat 56 is defined by combined surfaces of the sound chamber 32 and cover 34, when coaxially nested together. The one driver embodiment 30 of FIGS. 19–21 can be characterized as having a folded or re-entrant sound path beginning proximate the diaphragm 38 and ending in front of the horn mouth 35. As illustrated schematically in FIG. 22, for the one driver embodiment 30, the four sound chamber horn throats 56 form parallel parts of a sound path which increases in cross sectional area as the sound proceeds from the diaphragm to free space at the horn mouth. As best seen in FIGS. 6–12, four diaphragm exits or slots 58 penetrate the sound chamber 32 at the closed end front, providing fluid communication between the interior surface 60 and the exterior surface 62. The sound chamber horn throats 56 are debossed as troughs or grooves into the exterior surface 62 and begin at the closed end with respective transversely opening diaphragm exits or slots 58 disposed around integral phase plug 64. Preferably, four horn throats 56 diverge transversely or radially from the front, center portion 66 of the of the sound chamber 32, turning rearwardly and following the contour of the sound chamber's cup-shaped exterior surface 62. Three, five or more horn throats may be employed, so long as the resulting parallel horn throats result in an expanding sound path cross sectional area as does the example illustrated in FIG. 22

In the assembled horn loudspeaker 30, the four horn throats 56 terminate in an open space proximate the interior rear wall of cup-shaped housing 36. The sound path is effectively recombined at the terminus of the four horn throats and the recombined pressure wave is reflected forwardly, redirected by 180 degrees. The pressure wave follows the sound path and continues in the annular space between the exterior of the cover 34 and the interior of the cylindrical housing wall terminating distally in horn mouth 35 toward the front of the housing, exiting into free space through the horn mouth 35.

In functional terms, driver assembly 38 is driven by a voice coil suspended in the annular magnetic gap of magnet assembly 43 which provides magnetic flux across the magnetic gap. Cup-shaped sound chamber 32 has an interior surface and an exterior surface and carries a phase plug 64 on the interior surface surrounded by a plurality of slots or diaphragm exits 58 in fluid communication through the sound chamber. Sound chamber 32 further includes exterior surface 62 defining three boundary walls for a plurality of horn throat segments 56; each horn throat segment originating in a respective diaphragm exit 58. Cup-shaped cover 34 is coaxially fitted over the sound chamber and, together with the sound chamber, defines a fourth boundary wall for each said horn throat segment. Cup-shaped cover 34 is coaxially fitted over sound chamber 32 and housing 36 is adapted to coaxially receive the sound chamber and cover and defines an open horn mouth. The sound path defined by the modular siren loudspeaker provides an effective acoustic impedance match between the region in front of the diaphragm and free space, balancing pressure and velocity along the sound path. When the voice coil of diaphragm assembly 38 is excited by an alternating current or time varying signal, the diaphragm moves or oscillates linearly and creates an acoustic pressure wave in the region proximate the diaphragm and the interior surface 60 of the sound chamber 32. The acoustic pressure wave thus created propagates from the region proximate the diaphragm through the sound chamber diaphragm exits or slots 58 through the plurality of horn throat segments debossed or defined in the exterior surface 62 of sound chamber 32 and then is recombined and reflected against the housing closed rear wall 37, propagating further to the horn mouth at housing open front end 35 and into free space.

Figure 3:
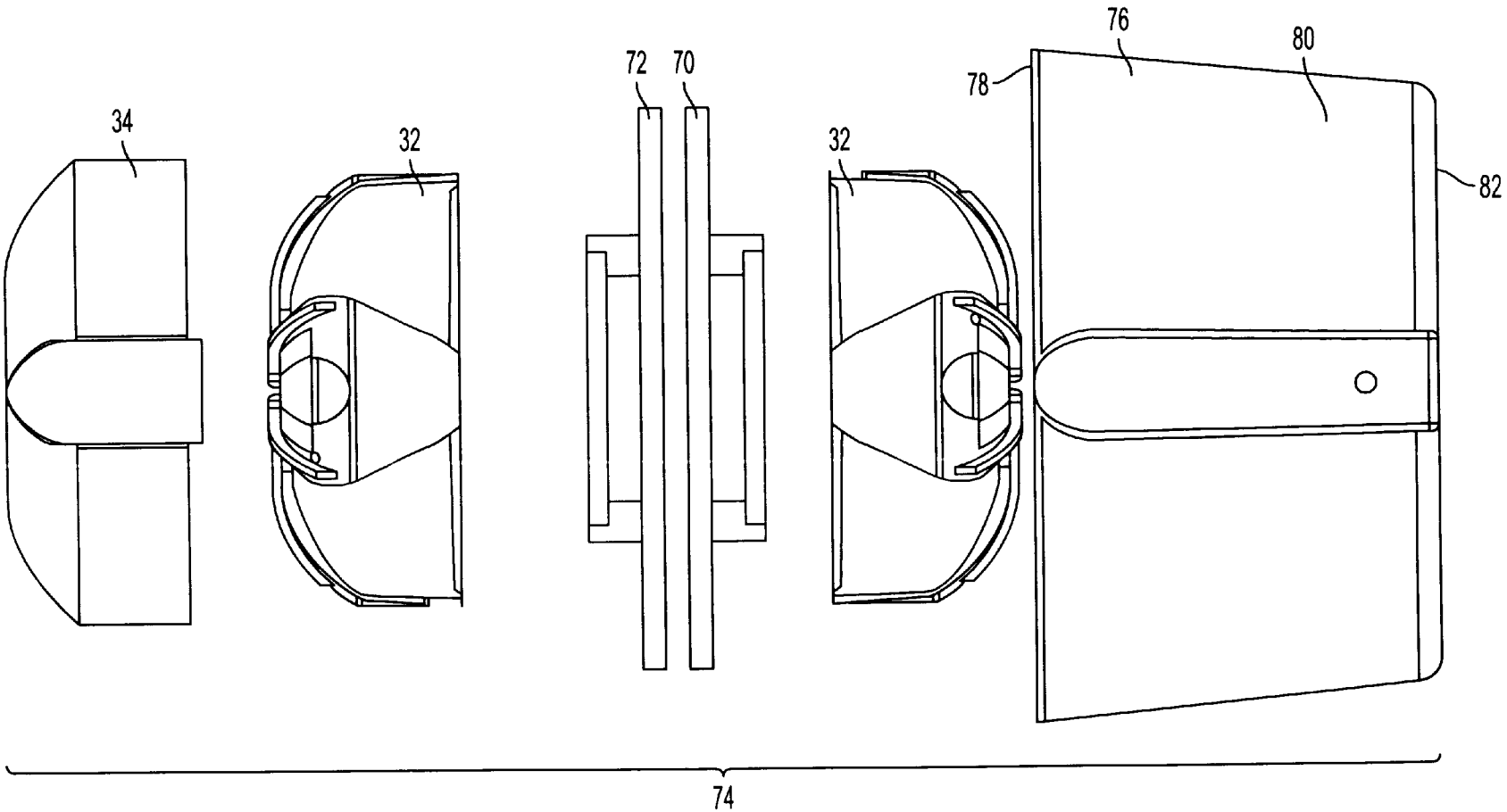
FIG. 3 is an exploded side view, in elevation, of the two driver embodiment of the modular horn loudspeaker, in accordance with the present invention.
Figure 5:
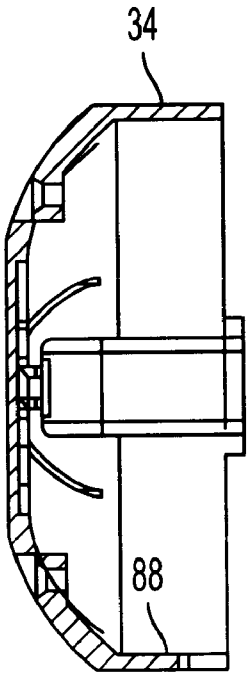
FIG. 5 is a side view in cross section of the modular horn loudspeaker sound chamber cover, in accordance with the present invention. The section is taken along line A—A as shown in FIG. 4.
Figure 4:
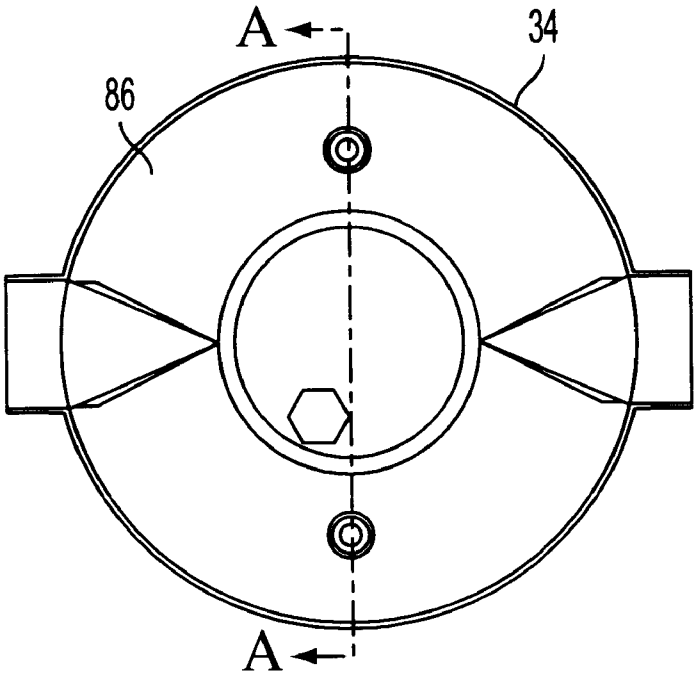
FIG. 4 is a top view in elevation of the modular horn loudspeaker sound chamber cover, in accordance with the present invention.

As best seen in FIG. 3, a second, two driver embodiment of the loudspeaker (hereinafter, the two driver loudspeaker 74) involves an alternate assembly method placing two drivers with magnet assemblies back-to-back, so that a first sound chamber's horn mouth exit apertures face a second sound chamber's horn mouth exit apertures. The resulting assembly yields eight paths from two sound chambers which blend into one coherent sound source, when placed in a housing adapted to accommodate two drivers. The back-to-back drivers are inserted in a larger bowl-shaped back cover or housing 76 having a first open end 78, a substantially frustoconical sidewall 80 and a closed back endwall 82 of only slightly smaller diameter, the housing being nearly cylindrical. A front cover 34 is tightly fitted over the front facing sound chamber 32. The magnet assemblies, 70, 72 being back-to-back, are not received within a fitted heat sink incorporated into the housing, as for the one driver embodiment.

Both the one driver and two driver embodiments of the modular siren loudspeaker are preferably fabricated from diecast aluminum. The one driver modular siren loudspeaker preferably utilizes a Neodymium magnetic 42 for reduced size. Alternatively, the magnetic circuit could be fabricated from conventional Alnico or Ferrite material for applications where size is not an important issue. Aluminum was selected as the housing heat sink material to provide thermal conductive properties for the temperature sensitive Neodymium magnet material. The use of Alnico or Ferrite materials allow the modular loudspeaker housing to be fabricated from plastic or other cast or molded materials having reduced thermal conductivity.

Figure 7:
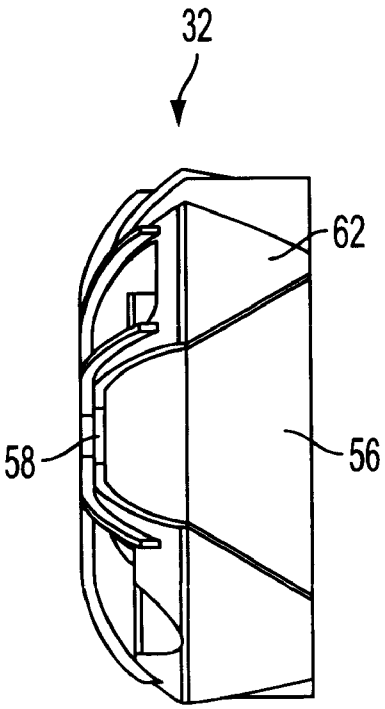
FIG. 7 is a side view, in elevation, of the sound chamber of FIG. 6, in accordance with the present invention.
Figure 6:
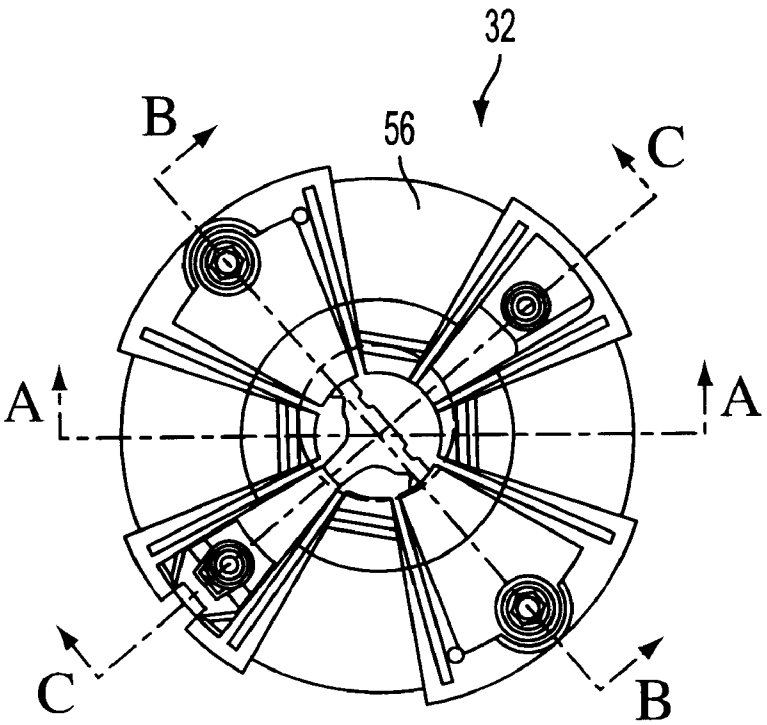
FIG. 6 is a top view in elevation of a second embodiment of the modular horn loudspeaker sound chamber in accordance with the present invention.
Figure 8:
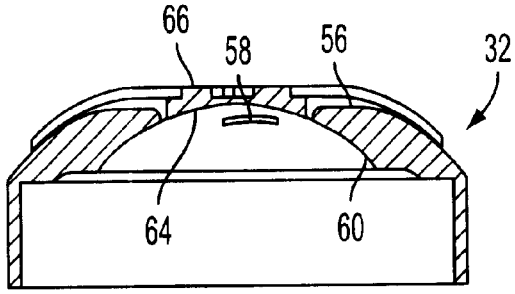
FIG. 8 is a cross sectional view, in elevation, of the sound chamber of FIG. 6, along section lines A—A, in accordance with the present invention.
Figure 9:
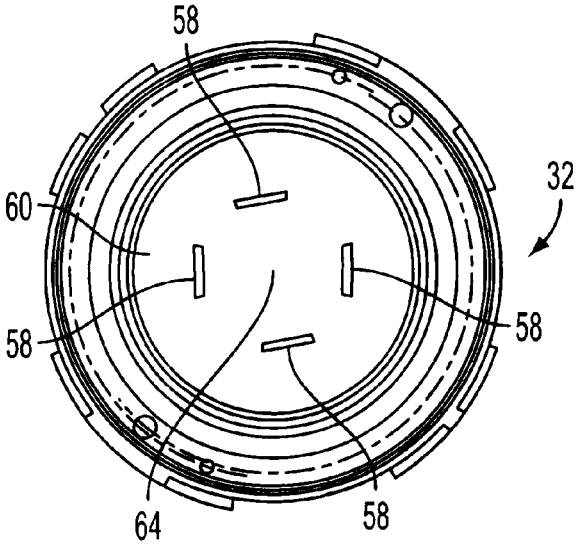
FIG. 9 is a bottom or inside view, in elevation, of the sound chamber of FIG. 6, in accordance with the present invention.
Figure 10:
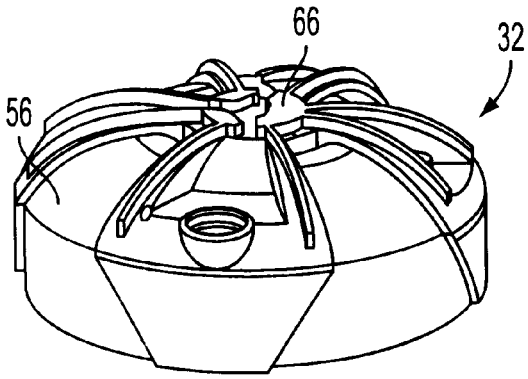
FIG. 10 is a perspective view of the sound chamber of FIG. 6, in accordance with the present invention.
Figure 12:
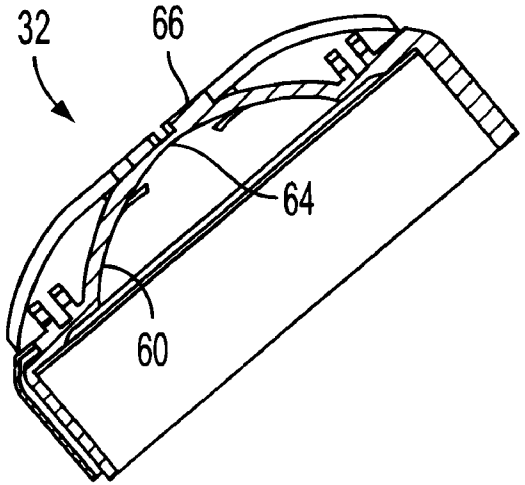
FIG. 12 is a cross sectional view, in elevation, of the sound chamber of FIG. 6, along section lines C—C, in accordance with the present invention.
Figure 11:
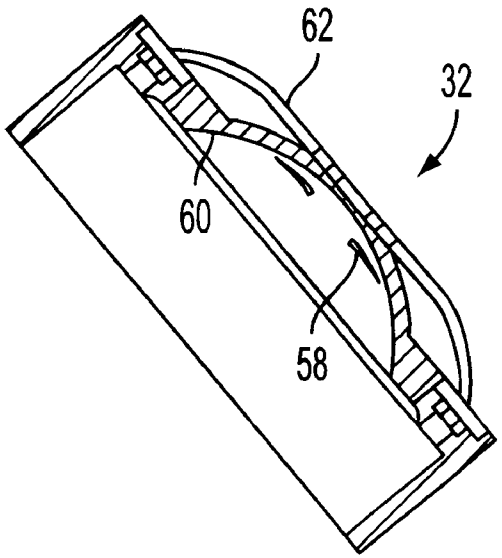
FIG. 11 is a cross sectional view, in elevation, of the sound chamber of FIG. 6, along section lines B—B, in accordance with the present invention.

Turning now to a more thorough examination of sound chamber 32, as best seen in FIGS. 2 and 6–12, the exterior surface 62 has a plurality of troughs, channels or grooves which vary in cross sectional area along their length to define horn throats of progressively expanding cross sectional area. FIG. 6 is a top view in elevation of a second embodiment of the modular siren loudspeaker sound chamber 32 and FIG. 8 is a cross sectional view, in elevation, along section lines A—A showing the penetration of a slot 58 through to the interior surface 62 proximate the integral phase plug 64 and illustrating the depth of the horn throat channels 56. FIG. 11 is a cross sectional view, in elevation, of the sound chamber of FIG. 6, along section lines B—B showing how the electrical connection terminals 44, 46 conduct through vias to make a connection with the diaphragm voice coil. Finally, FIG. 12 is a cross sectional view, in elevation, of the sound chamber of FIG. 6, along section lines C—C.

As can be seen from inspecting FIGS. 6 and 7, each horn throat 56 has a relatively uniform and constant channel depth, but increases in width from the slot 58 to the terminus of the channel at the rear edge of the sound chamber, thus providing the progressively expanding horn throat cross sectional area, as discussed above.

Figure 14:
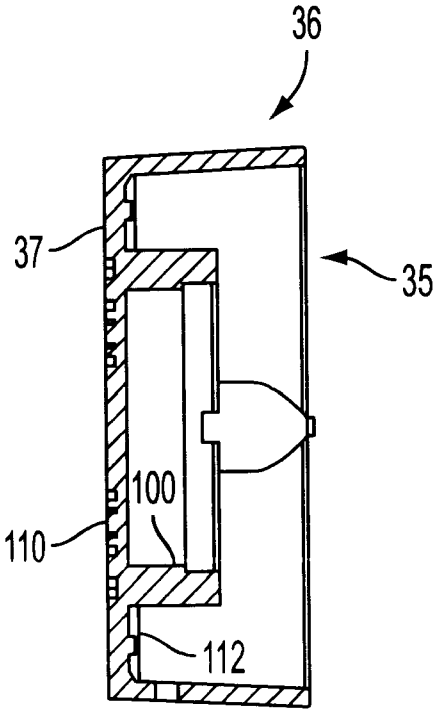
FIG. 14 is a cross sectional view, in elevation, of the housing of FIG. 13, in accordance with the present invention. The cross section is taken along lines A—A as seen in FIG. 13.
Figure 13:
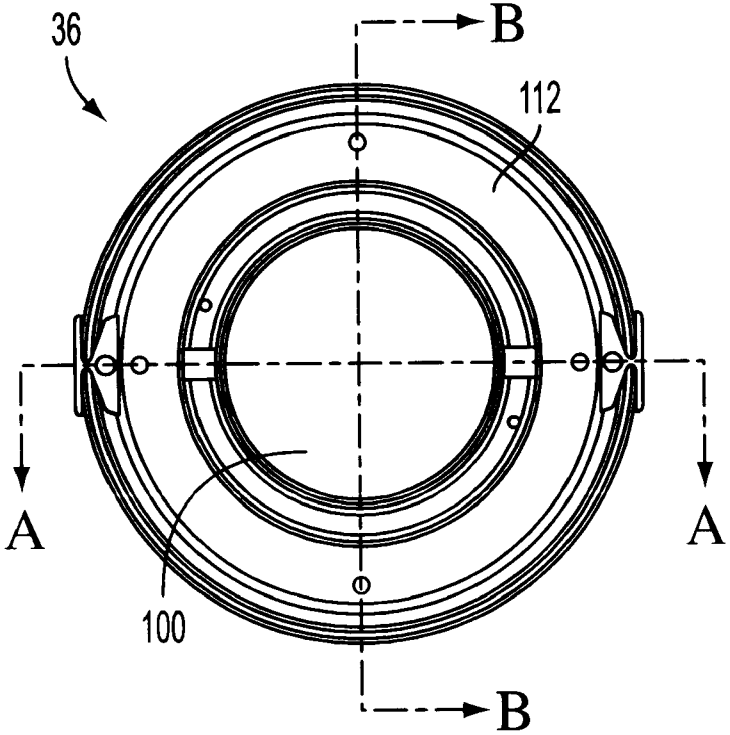
FIG. 13 is an inside or top view, in elevation, of the single driver embodiment of the modular horn loudspeaker housing, in accordance with the present invention.
Figure 15:
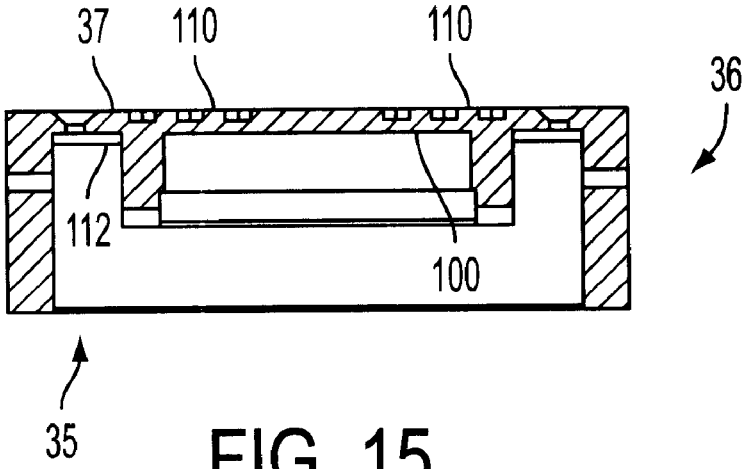
FIG. 15 is a cross sectional view, in elevation, of the housing of FIG. 13, in accordance with the present invention. The cross section is taken along lines B—B as seen in FIG. 13.

Turning now to FIGS. 13–18, as noted above, housing 36 is adapted to receive and support magnet assembly 43 (not shown) which is fitted into a pocket or receptacle 100 for sinking heat from the magnet assembly. The magnet is preferably bonded into the pocket with a thermally conductive adhesive. FIG. 13 is an inside or top view, in elevation, of the single driver embodiment of housing 36, and FIG. 14 is a cross sectional view, in elevation, of the housing of FIG. 13; the cross section is taken along lines A—A as seen in FIG. 13, showing the shape of the pocket sidewalls. FIG. 15 is a cross sectional view, in elevation, of the housing of FIG. 13; the cross section is taken along lines B—B as seen in FIG. 13. The pocket 100 is preferably configured as a right circular cylinder of a first, smaller radius and the housing outer wall is preferably configured as a coaxially aligned, concentric right circular cylinder of a second radius necessarily larger than the radius of the pocket which is nested therein. The annular interior surface 112 of the rear wall segment of the housing lying between the pocket side wall and the housing side wall is the reflective surface that the acoustic pressure wave is reflected from, as discussed above.

Figure 16:
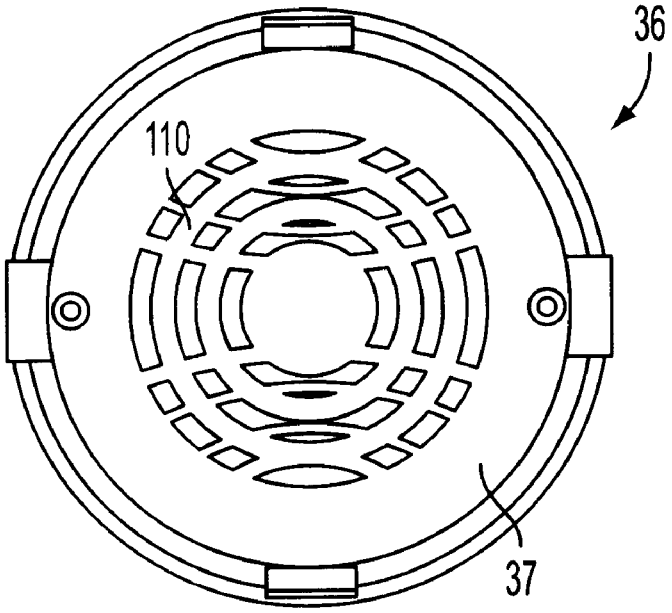
FIG. 16 is an outside or bottom view, in elevation, of the single driver embodiment of the modular horn loudspeaker housing, in accordance with the present invention.
Figure 17:
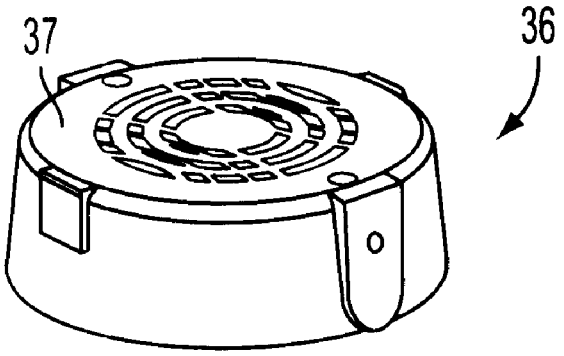
FIG. 17 is a perspective bottom or back view of the single driver embodiment of the modular horn loudspeaker housing, in accordance with the present invention.
Figure 18:
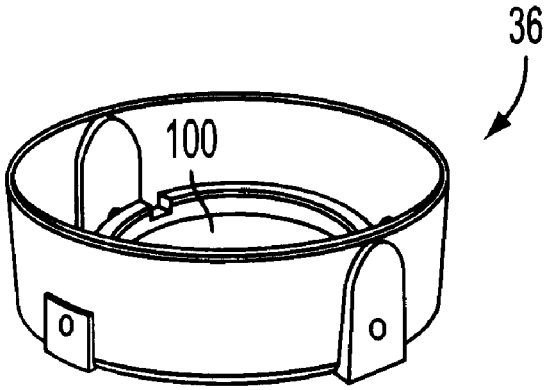
FIG. 18 is a perspective top or front view of the single driver embodiment of the modular siren loudspeaker housing, in accordance with the present invention.
Figure 19:
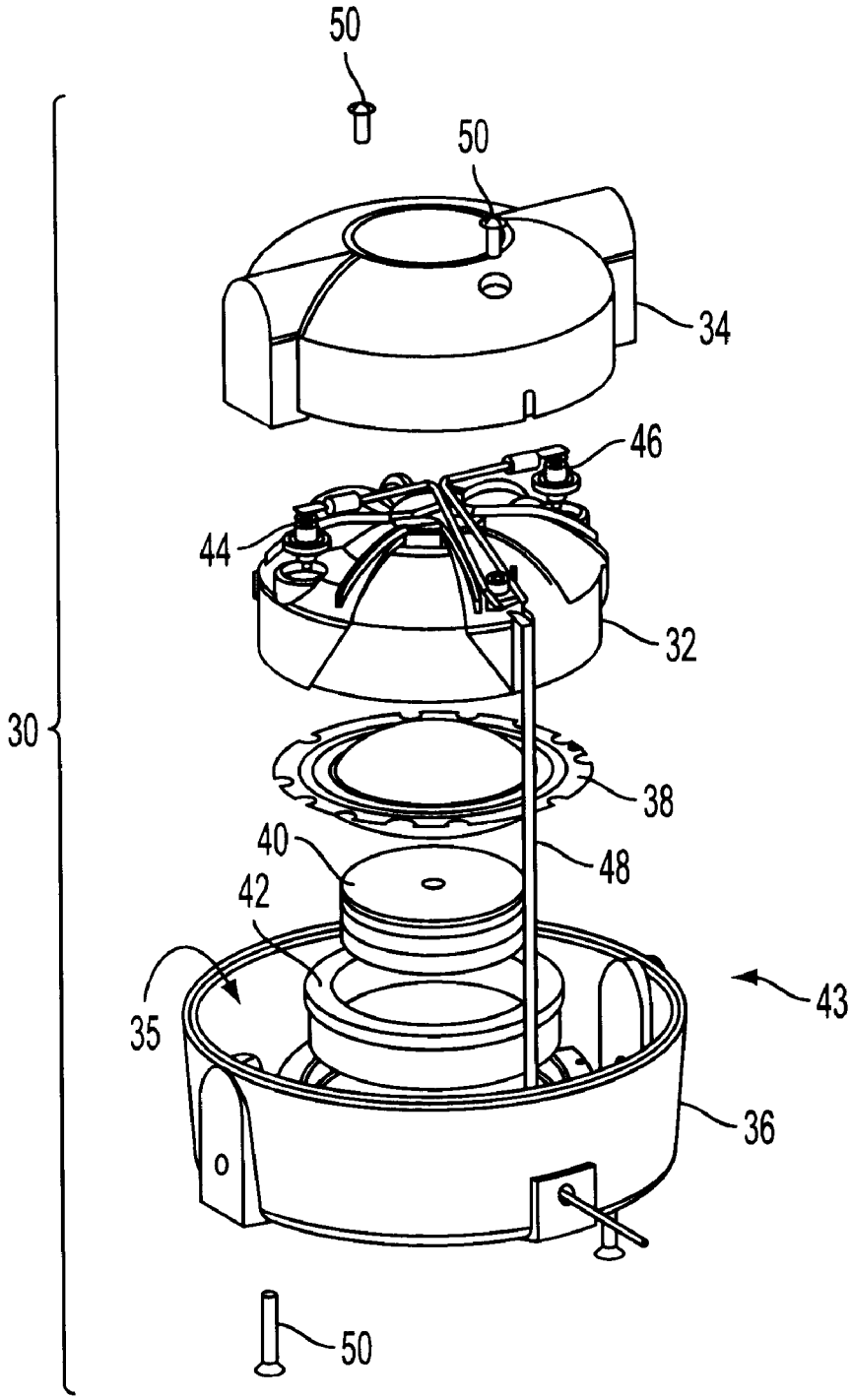
FIG. 19 is a perspective top or front exploded view of the single driver embodiment of the modular horn loudspeaker, in accordance with the present invention.
Figure 20:
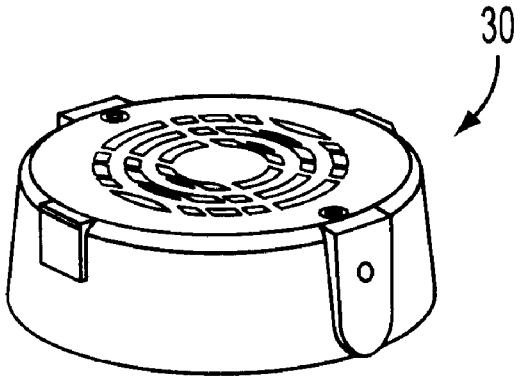
FIG. 20 is a perspective bottom or back view of the single driver embodiment of the assembled modular horn loudspeaker, in accordance with the present invention.
Figure 21:
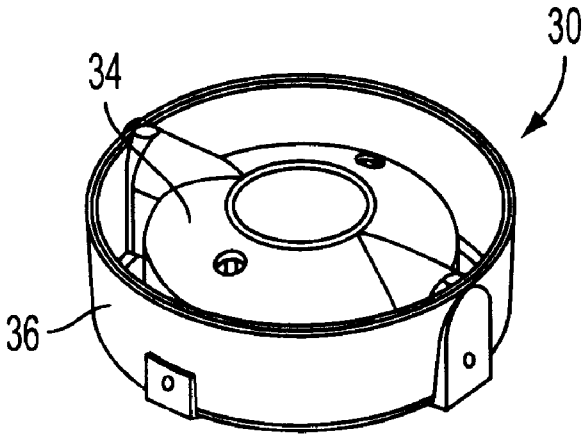
FIG. 21 is a perspective top or front view of the single driver embodiment of the assembled modular horn loudspeaker, in accordance with the present invention.
Figure 22:
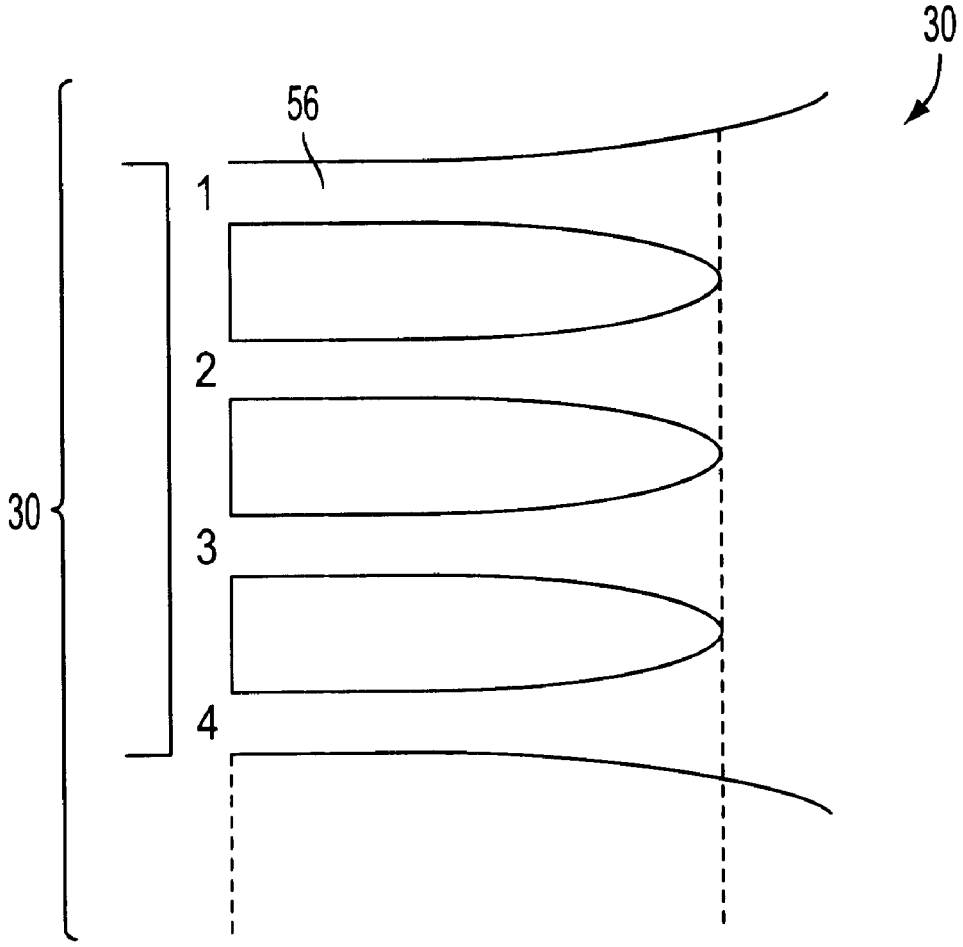
FIG. 22 is a schematic diagram illustrating the relative cross sections of the acoustic paths provided by the assembled modular horn loudspeaker, in accordance with the present invention.

FIG. 16 is an outside or bottom view, in elevation, of housing 36. Finally, FIG. 17 is a perspective bottom or back view of the single driver embodiment of the housing, and FIG. 18 is a perspective top or front view of the housing. As noted above, housing 37 is closed at the back or rear end wall 37 and open at the front, such that horn mouth 35 couples acoustic energy to external air. Additionally, it is shown in FIGS. 14, 15 and 17 that the thermally conductive housing 37 includes (on the rear wall surface disposed substantially opposite open horn mouth 35) a plurality of heat sink surface features 110 adapted to conduct, convect or radiate thermal energy from magnet pocket 100 into the air (or any other fluid) surrounding the housing. In the embodiment illustrated, the features are formed by casting or machining grooves or troughs into the thermally conductive material of the housing. As best seen in FIG. 16, the grooves are preferably in the shape of discontinuous circular segments arrayed in circles of increasing radius disposed concentrically with respect to the circular magnet pocket 100.

The modular loudspeaker of the present invention is characterized as a siren loudspeaker, but could be used very effectively in sound reinforcement, public address or other applications requiring use of a horn-loaded loudspeaker. The housing and other major components are shown in preferred embodiments having cup-shaped components with substantially circular cross sections; other shapes are easily implemented. In particular, the modular loudspeaker of the present invention could have a square housing into which is fitted a square sound chamber covered by a fitted square cover to define a plurality of horn throats.

Having described preferred embodiments of a new and improved modular siren loudspeaker and method, it is believed that other modifications, variations and changes will be suggested to those skilled in the art in view of the teachings set forth herein. It is therefore to be understood that all such variations, modifications and changes are believed to fall within the scope of the present invention as defined by the appended claims.

What is claimed is:

1. A modular horn loudspeaker adapted for use in corrosive or harsh environments, comprising:

a driver including a diaphragm driven by a voice coil, said voice coil being suspended in a magnetic gap, said driver further including a magnet disposed proximate said magnetic gap to provide magnetic flux across said magnetic gap such that when an alternating current signal is passed through said voice coil, said diaphragm is displaced in relation to said magnetic gap, thereby creating an acoustic pressure wave in a first region proximate said diaphragm;

a cup-shaped sound chamber having an interior surface and an exterior surface and carrying a phase plug on said interior surface and surrounded by a plurality of diaphragm exits being in fluid communication through said sound chamber, said sound chamber further including an exterior surface with a radial array of debossed troughs defining a plurality of horn throat segment walls; each horn throat segment wall originating in a respective diaphragm exit; said sound chamber interior surface being disposed proximate said diaphragm;

a cup-shaped cover coaxially fitted over the sound chamber and, together with said sound chamber, defining a boundary for each said horn throat segment, whereby said acoustic pressure wave propagates from said first region proximate said diaphragm, through said plurality of diaphragm exits and through said plurality of horn throat segments; and a housing adapted to coaxially receive said sound chamber and said cover and defining an open horn mouth, whereby said acoustic pressure wave propagates from said plurality of horn throat segments and out through said open horn mouth.

2. The modular horn loudspeaker of claim 1, wherein said housing is cup-shaped and adapted to receive a single driver, said cup-shaped sound chamber and said cup-shaped cover.

3. The modular horn loudspeaker of claim 1, wherein said housing is made from a thermally conductive material.

4. The modular horn loudspeaker of claim 3, wherein said thermally conductive material is a metal.

5. The modular horn loudspeaker of claim 4, wherein said thermally conductive metal is aluminum.

6. The modular horn loudspeaker of claim 3, wherein said thermally conductive housing includes a rear wall surface disposed substantially opposite said open horn mouth; said rear wall surface including a plurality of heat sink surface features adapted to conduct, convect or radiate thermal energy into the air surrounding the housing.

7. The modular horn loudspeaker of claim 3, wherein said housing includes a receptacle sized to receive and conduct heat away from said driver magnet.

8. The modular horn loudspeaker of claim 7, said driver magnet and said housing receptacle being bonded to one another with a thermally conductive adhesive.

9. The modular horn loudspeaker of claim 7, said driver magnet being made from neodymium.

10. The modular horn loudspeaker of claim 1, wherein each of said debossed troughs defining said horn throat segment walls is substantially rectangular in cross sectional shape.

11. The modular horn loudspeaker of claim 1, wherein said housing is adapted to receive said driver and a second driver, said cup-shaped sound chamber and a second cup-shaped sound chamber disposed over said second driver and said cup-shaped cover and a second cover disposed over said second sound chamber.

12. The modular horn loudspeaker of claim 11, wherein said housing has a frustoconically tapered cylindrical side wall.

13. A modular siren loudspeaker adapted for use in corrosive or harsh environments, comprising:

a siren driver including a diaphragm driven by a voice coil, said voice coil being suspended in a magnetic gap, said driver further including a magnet disposed proximate said magnetic gap to provide magnetic flux across said magnetic gap such that when an alternating current signal of a selected frequency is passed through said voice coil, said diaphragm is displaced in relation to said magnetic gap, thereby creating an acoustic pressure wave of the selected frequency in a first region proximate said diaphragm;

a cup-shaped sound chamber having an interior surface and an exterior surface and carrying a phase plug surrounded by a plurality of slots penetrating said sound chamber, said sound chamber further including an exterior surface with a radial array of horn throat segments bounded by walls; each horn throat segment wall originating in a respective slot;

a cup-shaped cover coaxially fitted over said sound chamber and, together with said sound chamber, defining a boundary for each said horn throat segment, whereby said acoustic pressure wave propagates from said first region proximate said diaphragm, through said plurality of slots and through said plurality of horn throat segments; and a housing adapted to coaxially receive said sound chamber and said cover and defining an open horn mouth, whereby said acoustic pressure wave propagates from said plurality of horn throat segments and out through said open horn mouth.

14. The modular siren loudspeaker of claim 13, wherein said housing is cup-shaped and adapted to receive a single driver, said cup-shaped sound chamber and said cup-shaped cover.

15. The modular siren loudspeaker of claim 13, wherein said housing is made from a thermally conductive material.

16. The modular siren loudspeaker of claim 15, wherein said thermally conductive material is a metal.

17. The modular siren loudspeaker of claim 16, wherein said thermally conductive metal is aluminum.

18. The modular siren loudspeaker of claim 15, wherein said thermally conductive housing includes a rear wall surface disposed substantially opposite said open horn mouth; said rear wall surface including a plurality of heat sink surface features adapted to conduct, convect or radiate thermal energy into the air surrounding the housing.

19. The modular siren loudspeaker of claim 15, wherein said housing includes a receptacle sized to receive and conduct heat away from said driver magnet.

20. The modular siren loudspeaker of claim 19, said driver magnet and said housing receptacle being bonded to one another with a thermally conductive adhesive.

21. The modular siren loudspeaker of claim 19, said driver magnet being made from neodymium.

22. The modular siren loudspeaker of claim 13, wherein each of said horn throat segments is substantially rectangular in cross sectional shape.

23. The modular siren loudspeaker of claim 13, wherein said housing is adapted to receive said driver and a second driver, said cup-shaped sound chamber and a second cup-shaped sound chamber disposed over said second driver and said cup-shaped cover and a second cover disposed over said second sound chamber.

24. The modular siren loudspeaker of claim 23, wherein said housing has a frustoconically tapered cylindrical side wall.

* * * * *